United States Patent [19]

Weitzler

[11] Patent Number: 4,905,623

[45] Date of Patent: Mar. 6, 1990

[54] SUPPORT STRUCTURE FOR USE WITH A FLUID MEDIUM

[76] Inventor: David A. Weitzler, 25 Fraser Rd., Framingham, Mass. 01701

[21] Appl. No.: 220,643

[22] Filed: Jul. 18, 1988

[51] Int. Cl.[4] ..... B63B 35/00

[52] U.S. Cl. ..... 114/264; 114/266; 405/71

[58] Field of Search ..... 114/258, 261, 264, 265, 114/266, 267; 441/1, 35, 44, 45; 16/2.6, 27, 28, 29; 405/23, 26, 62, 63, 64, 65, 70, 71

[56] References Cited

U.S. PATENT DOCUMENTS 3,651,647 3/1972 Flaviani ..... 405/71

4,033,137 7/1977 Geist ..... 405/71

*Primary Examiner*—Sherman D. Basinger

*Assistant Examiner*—Jesus D. Sotelo

*Attorney, Agent, or Firm*—John E. Toupal; Harold G. Jarcho

[57] ABSTRACT

A support structure for use with a fluid medium and including a plurality of buoys adapted for arrangement in a floating array at the surface of a body of the fluid medium and mooring elements connected between the buoys and adapted to prevent any substantial relative movement therebetween in directions parallel to the array and to allow substantial relative movement therebetween in directions perpendicular to the array.

28 Claims, 8 Drawing Sheets

SUPPORT STRUCTURE FOR USE WITH A FLUID MEDIUM

BACKGROUND OF THE INVENTION

This invention relates generally to a support structure for objects and, more particularly, to a support structure in which an object is supported by interconnected arrays of members buoyant in a fluid medium.

Water filled vinyl bags or "waterbeds" are used extensively as mattresses. Basically, they provide a degree of comfort which had previously been unrealized. Although very popular, the waterbed exhibits drawbacks that are very apparent and limit their use in other applications including recreational.

When using a waterbed one tends to bounce on dynamic waves and bind upon the static waveform which compliments one's body. The taut skin of a waterbed does the damage; firstly, by amplifying the inner water's natural wave and hence sea-sickness producing surface tension and secondly, by supplementing the support of a uniform inner pressure near deeply penetrated areas with a binding tangential friction between the taut skin and one's body. Other disadvantages of a waterbed include requirements for sturdy structure to support their massive filled weight and for electric heaters which can warm their otherwise chilly water fill.

The object of this invention, therefore, is to provide an improved structure for supporting objects on a fluid medium.

SUMMARY OF THE INVENTION

The invention is a support structure for use with a fluid medium and including a plurality of buoys adapted for arrangement in a floating array at the surface of a body of the fluid medium and mooring means connected between the buoys and adapted to prevent any substantial relative movement therebetween in directions parallel to the array and to allow substantial relative movement therebetween in directions perpendicular to the array. Because of the localized response to applied force exhibited by the individual buoys, the array provides a desirable cushioning characteristic for supported objects.

One feature of the invention is a limit mechanism for limiting the maximum relative movement between the buoys in the perpendicular directions. The limit maintains the structural integrity of the array.

According to another feature of the invention, each of the buoys is an elongated member with a longitudinal axis adapted for orientation substantially perpendicular to the array. The perpendicularly oriented, elongated buoys enhance the desired cushioning effect provided by the array.

According to yet another feature of the invention, the mooring means comprises a coupling mechanism connected between each buoy and each directly adjacent buoy in the array. The coupling mechanism is adapted to maintain a parallel relationship between the longitudinal axes of the elongated buoys while allowing relative movement therebetween.

According to further features of the invention each coupling mechanism comprises a pair of engaged elements each attached to a different one of the adjacent buoys and the engaged elements are adapted for relative rectilinear sliding contact that relative rectilinear movement prevents changes in orientation between the longitudinal axes of the attached buoys.

In one embodiment of the invention each pair of engaged coupling elements comprises a ring and an elongated rod retained therein. The ring and rod elements establish in a compact structure the desired rectilinear motion.

In another embodiment each pair of engaged coupling elements comprises an elongated channel defined by one of the attached buoys and an elongated rod retained thereby and all of the rods are connected by connector means. The interconnected channel retained rods also provide in an efficient structure the desired rectilinear motion.

In yet another embodiment of the invention, the mooring means comprises a band means surrounding the periphery of the array of buoys and maintaining relatively loose transverse contact therebetween so as to prevent relative parallel movement while allowing relative perpendicular movement therebetween. The band is yet another simple structure for facilitating the desired buoy array control.

One feature of the above embodiment is the provision of a sealed compartment above the array. In this embodiment, the movement of individual buoys can dissipate wave energy in the fluid medium and thereby establish a highly stable support surface for objects such as buildings.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
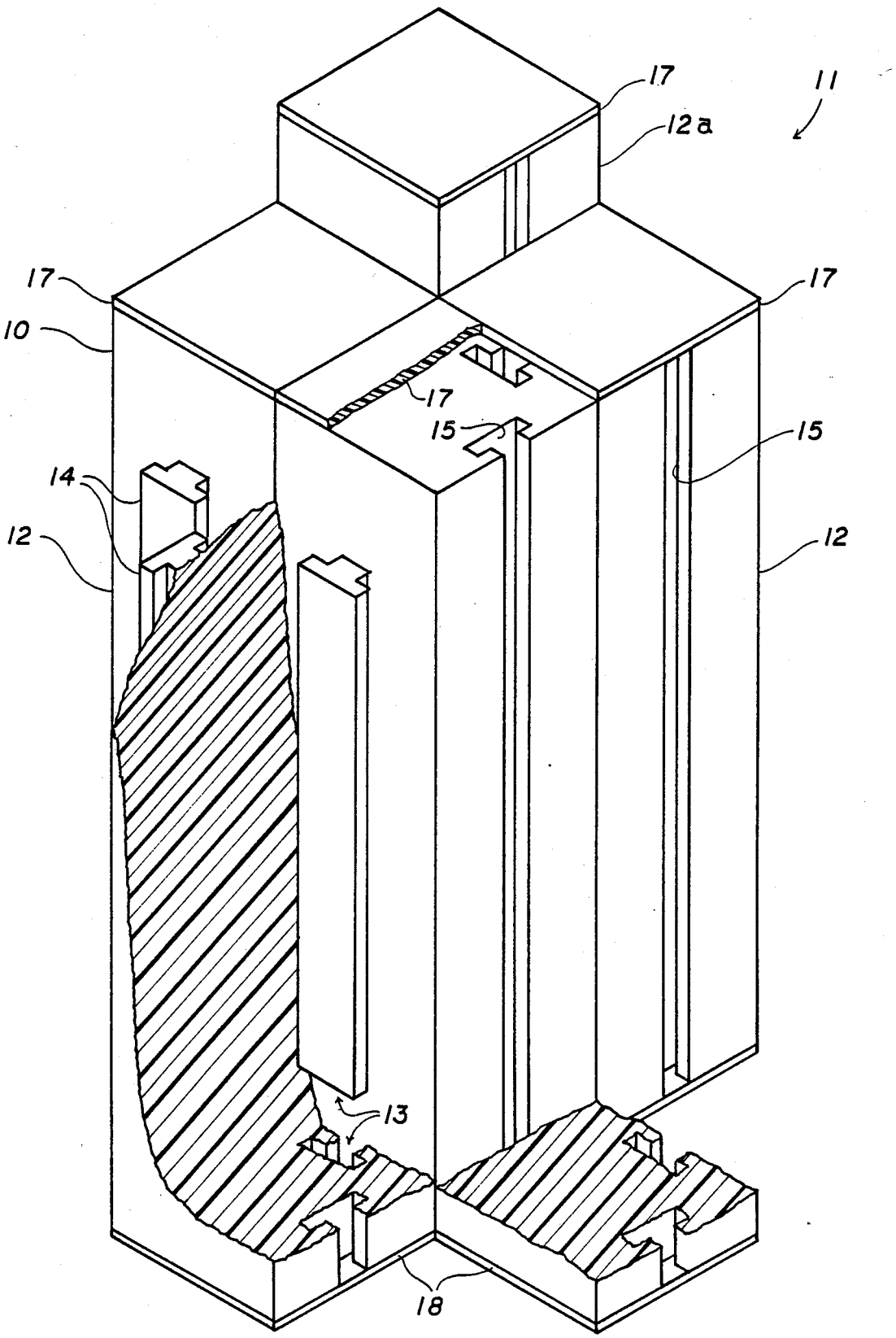
FIG. 1 is a partially cut away perspective view of a support structure according to the invention.

A support structure 11 according to the invention is illustrated in FIG. 1. The structure 11 includes a two dimensional array 10 of elongated buoys 12 of square cross-section and having parallel, longitudinal axes oriented perpendicular to the array. Each pair of directly adjacent buoys 12 in the array 10 is joined by a mooring 13. Forming each mooring 13 are a pair of engaged elements, specifically an elongated, T-shaped appendage rod 14 on one buoy 12 and a T-shaped, elongated channel 15 on an adjacent buoy 12*a*. Each pair of engaged coupling elements 14 and 15 prevents any substantial relative movement between their connected buoys 12 in directions parallel to the array 10 while permitting substantial relative rectilinear movement therebetween parallel to their longitudinal axes and perpendicular to the array 10. The moorings 13 maintain for all buoys 12 in the array 10 a predetermined relative orientation while permitting relative movement therebetween in directions perpendicular to the array as shown by the relative displacement in the array 10 of the buoy 12*a*.

Figure 2:
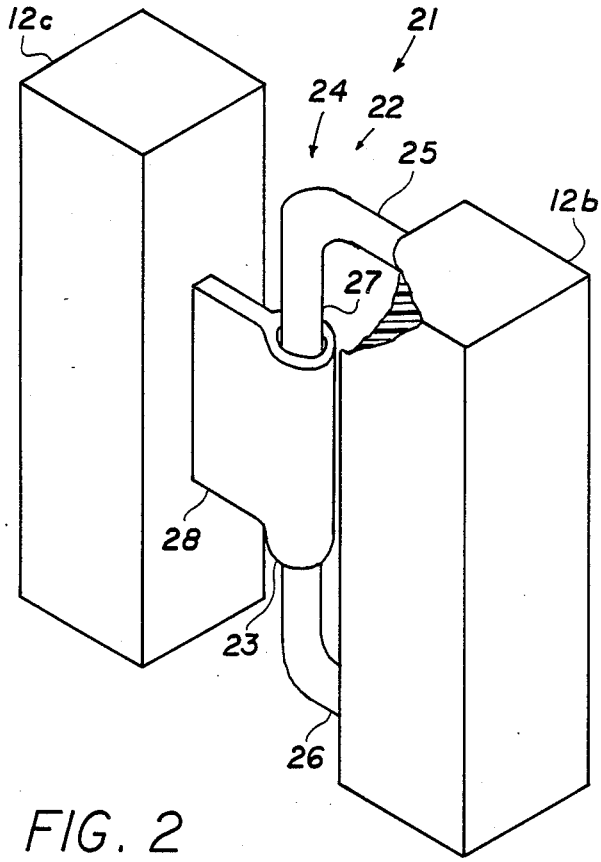
FIGS. 2–4 are partial perspective views of other support structures with modified coupling elements.

FIG. 2 illustrates another support structure 21 employing a two dimensional array of buoys 12*b*, 12*c* each buoyant in a fluid medium such as water but with a modified mooring structure 22. The mooring structure 22 is again formed by a pair of engaged coupling elements, specifically, an elongated cylindrical ring 23 and a U-shaped rod 24 slidably retained therein. Ends 25, 26 of the rod 24 are fixed to one buoy 12*b* of an array while a mid-portion 27 is fitted through the ring 23. Connecting the ring 23 to an adjacent buoy 12*c* in the array 12*c* is a fixed bracket 28. As in the above described embodiment 11, the coupling elements 23, 24 maintain a predetermined orientation between the buoys 12*b*, 12*c* by limiting relative movement therebetween to rectilinear paths substantially perpendicular to a two dimensional array in which they are disposed. The use of embodiment 21 is similar to that described above for embodiment 11.

Figure 3:
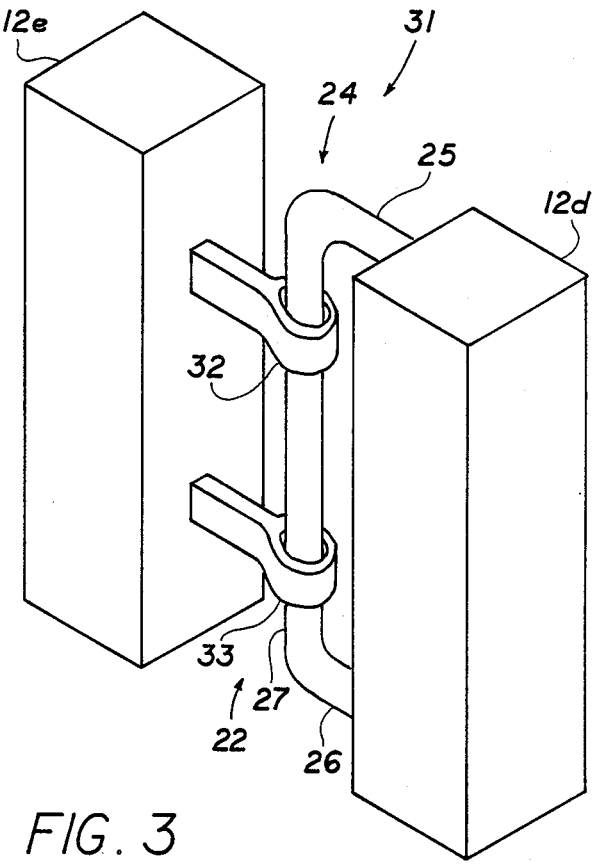

Illustrated in FIG. 3 is another support structure embodiment 31 similar to the embodiment 21 shown in FIG. 2. In the embodiment 31, the elongated cylindrical ring 23 of embodiment 21 is replaced by a pair of spaced apart cylindrical rings 32, 33. Together the rings 32, 33 slidably retain the mid-portion 27 of a U-shaped rod 24 to maintain a predetermined orientation between a pair of attached buoys 12*e*, 12*d* and to restrict relative movement therebetween to rectilinear paths substantially parallel to a two dimensional array in which they are disposed. In each of the embodiments 21 and 31, the ends 25, 26 of the rods 24 limit the maximum movement allowed between adjacent buoys.

Figure 4:
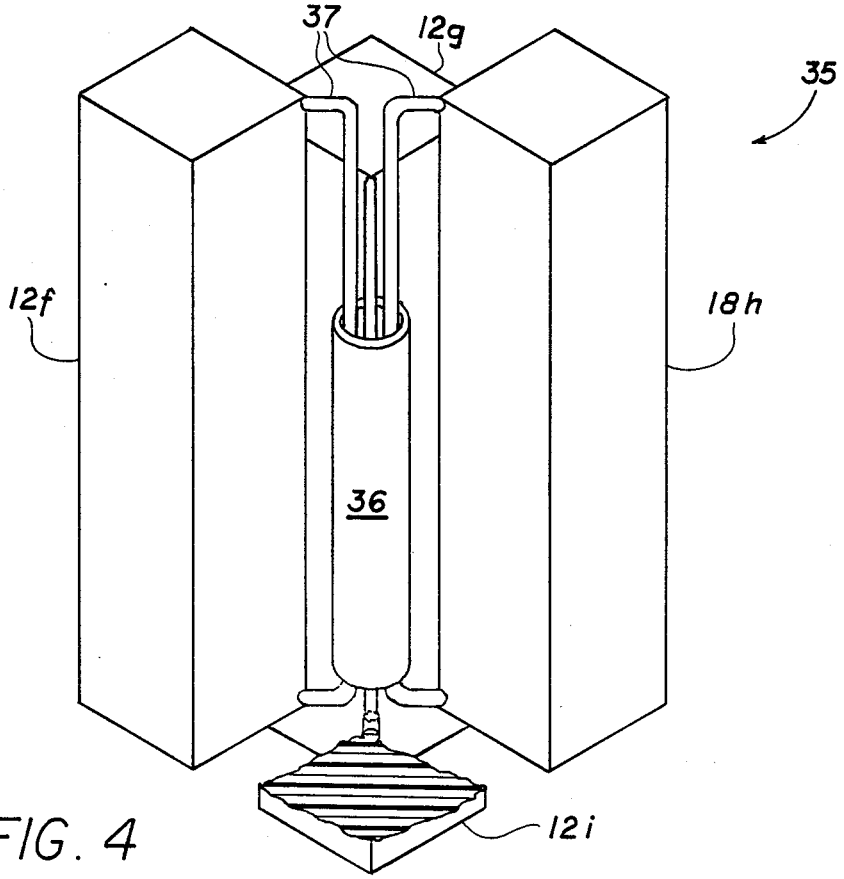

Illustrated in FIG. 4 is another support structure embodiment 35 that is similar to the embodiments 21 and 31. However, the embodiment 35 includes a modified mooring composed of a single coupling ring element 36 retaining a plurality of U-shaped coupling rod elements 37 each having ends fixed to a different one of a plurality of buoys 12*f*–12*i* forming a two dimensional array. In the embodiment 35, the ring element 36 in combination with each of the rods 37 functions as a coupling element fixed to one of the buoys 12*f*–12*i* and engaged with three other rods 37, each fixed to an adjacent buoy in the array. Again, the use of the embodiment 35 is similar to that described above for the embodiment 11.

Figure 5:
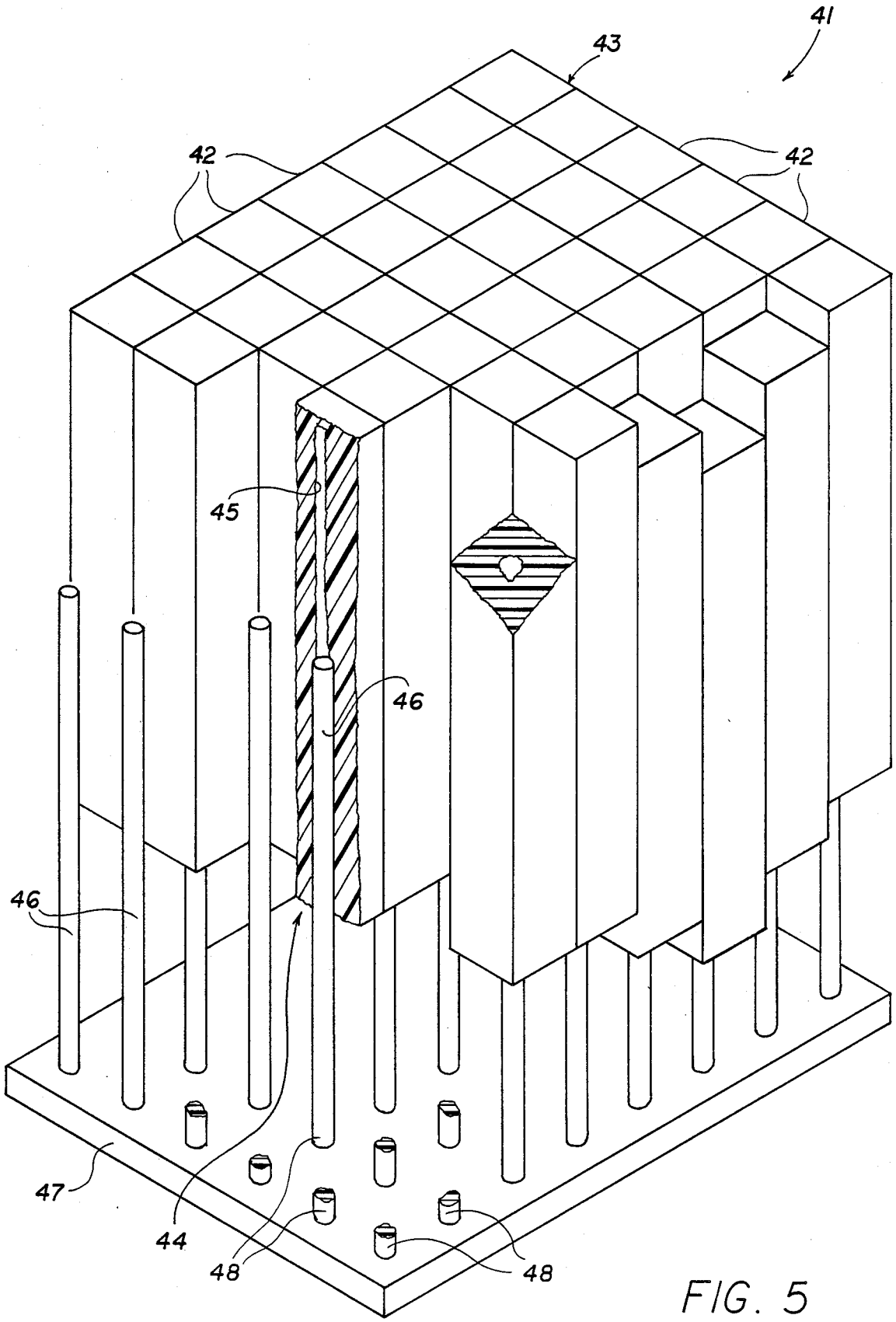
FIG. 5 is a partial perspective view of another support structure embodiment of the invention.

Illustrated in FIG. 5 is another support structure embodiment 41 including a plurality of elongated buoys 42 having square cross-sections and all buoyant in a fluid medium such as water and arranged in a two-dimensional array. Connected between each pair of adjacent buoys 42 in the array 43 is a mooring 44 consisting of a cylindrical central channel 45 in each buoy 42, a cylindrical rod 46 retained therein and a connector base 47 to which are attached ends 48 of the rods 46 that project out of the channels 45. As in the above described embodiments, the moorings 44 maintain between the buoys 42 predetermined orientations for their longitudinal axes and limit relative movement therebetween to rectilinear paths in directions substantially perpendicular to the array 43. The use of the embodiment 41 is similar to that described above for embodiment 11 of FIG. 1.

Figure 6:
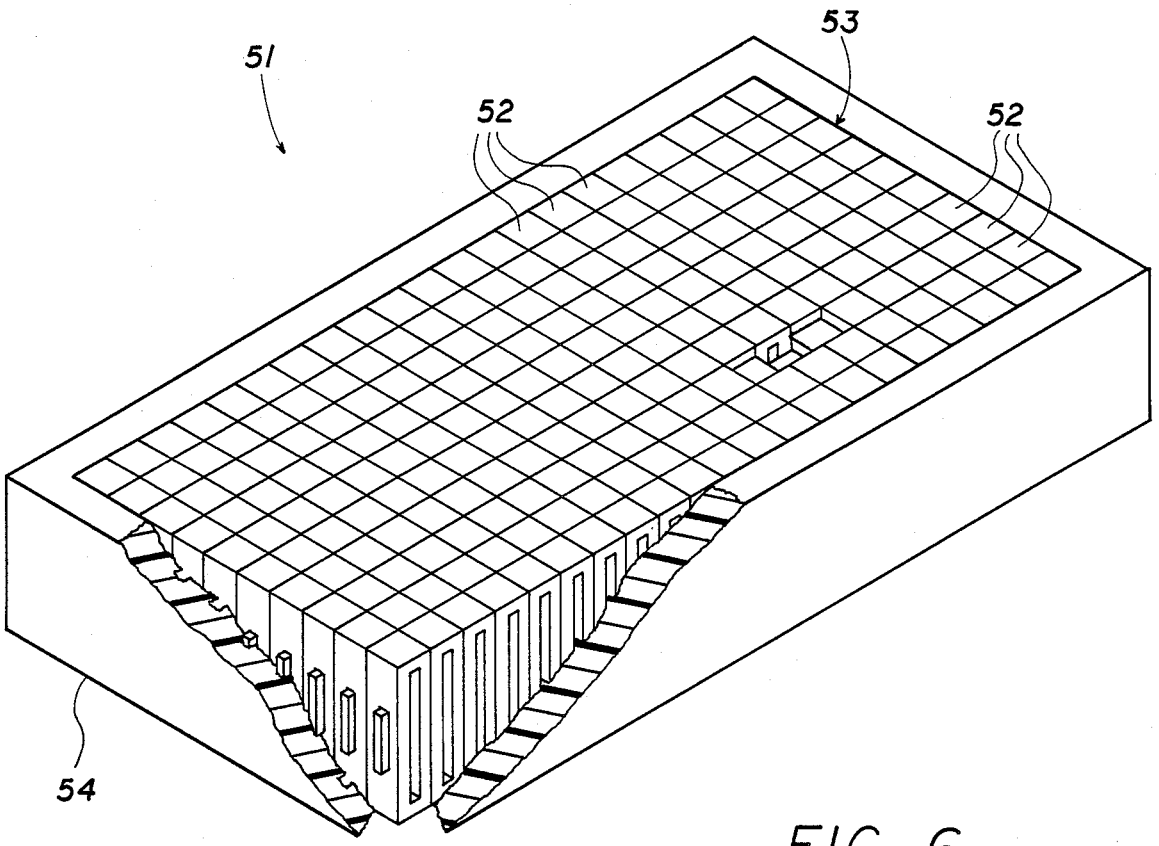
FIG. 6 is a partially cut away perspective view of another support structure embodiment of the invention.

FIG. 6 illustrates another support structure embodiment 51 including a plurality of elongated buoys 52 having square cross-sections and again arranged in a two dimensional array 53. An open ended box 54 bands the outer periphery of the array 53 to maintain a relatively loose transverse contact between the buoys 52. The box prevents relative movement between the buoys 52 in directions parallel to the array 53 while allowing relative movement perpendicular thereto. Thus, the banding box 54 maintains for the buoys 52 given orientations wherein their longitudinal axes are maintained parallel. The use of the embodiment 51 again is similar to that described above for the embodiment 11 of FIG. 1.

Figure 7:
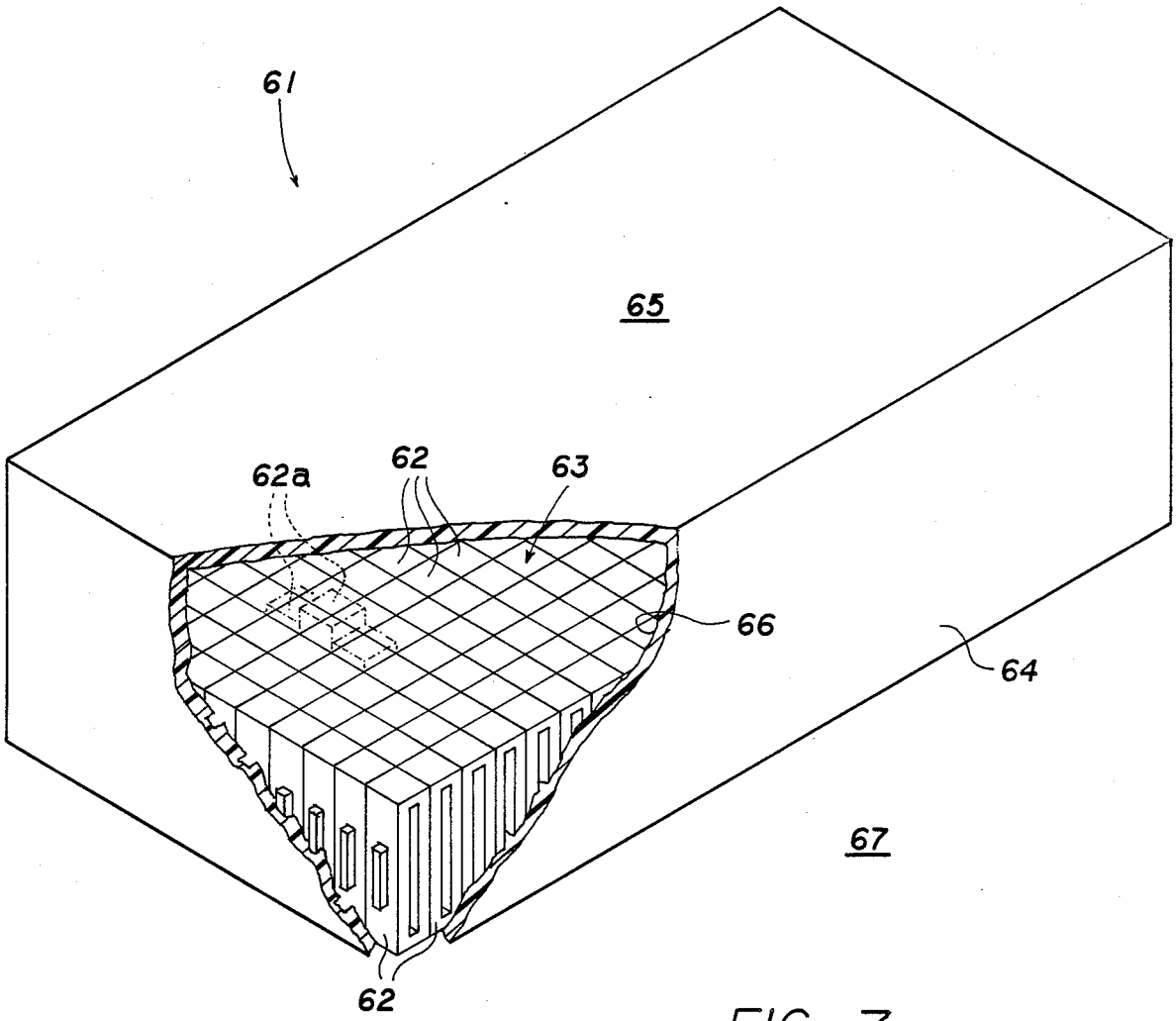
FIGS. 7–9 are partially cut away perspective views of yet other support structure embodiments of the invention.

Illustrated in FIG. 7 is another support structure embodiment 61 similar to the embodiment 51 shown in FIG. 6. Again, a plurality of elongated buoys 62 of square cross-section are arranged in a two dimensional array 63. Each of the buoys 62 is buoyant in a given fluid medium such as water. Banding the outer periphery of the array 63 is an open bottomed box 64. However, in this embodiment 61, the upper end of the box 64 is closed by a top 65 to form a closed, sealed compartment 66 above the array 63.

During use, the embodiment 61 is disposed in a body of water and the buoyant array 63 floats at the surface thereof. However, rather than the upper surfaces of the individual buoys 62 forming a support surface, a surface is formed by the top 65 of the box 64. The support surface top 65 can function to support any structures desired such as buildings or the like. When the structure 61 is subjected to wave motion in the fluid body 67, the forces produced by that motion cause upward movement of individual buoys 62*a* as shown by dashed lines in FIG. 7. Again, the movement of the buoys 62 is limited by the mooring box 64 to rectilinear motion in directions perpendicular to the array 63 and given parallel orientations are maintained for their longitudinal axes. During movement into the sealed compartment 66, individual buoys 62 selectively absorb wave energy in the fluid body 67 to maintain for the support surface top 65 a substantially stable orientation, free of undesirable pitch or roll.

Figure 8:
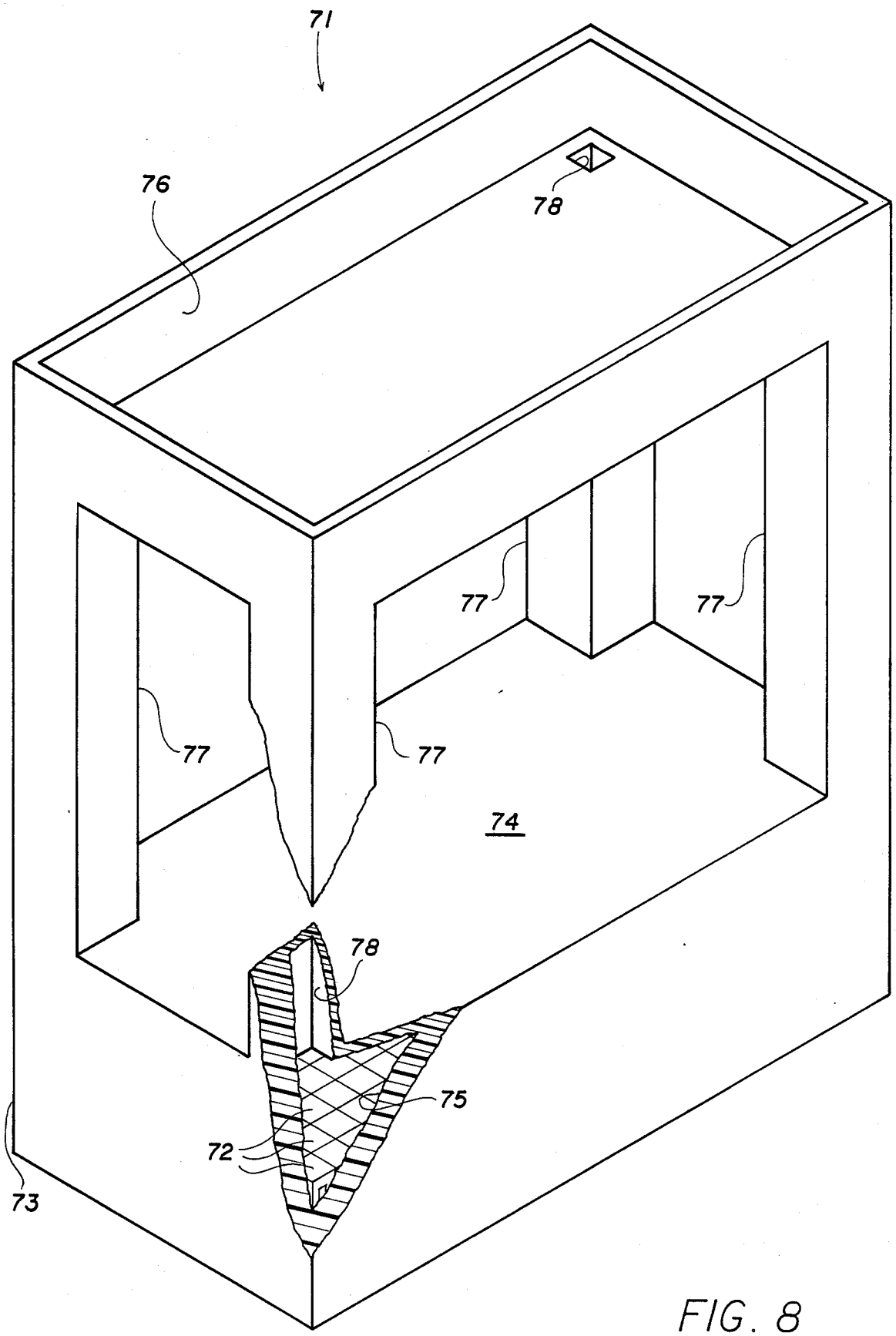

A support structure 71 similar to the support structure embodiment 61 is shown in FIG. 8. Again the periphery of a two dimensional array of buoys 72 is retained by an open bottomed box 73 having a cover 74 that forms a compartment 75 above the array. However, in this embodiment 71, a fluid reservoir 76 is supported above the cover 74 by columns 77. Each of the columns 77 defines a central open passage 78 extending between the compartment 75 and the reservoir 76.

The use of the support structure embodiment 71 is similar to that described above for the embodiment 61. However, in this case, the compartment 75 and the reservoir 76 are filled with a suitable fluid such as water which provides hydraulic damping of the buoys 72. Wave generated upward movement of any buoys 72 displaces from the compartment 75 a volume of water corresponding to the degree of buoy movement. The displaced water is forced into the reservoir 76 via the open passages 78. A subsequent return of the buoy into its quiescent position is accompanied by a compensating return flow of water to the compartment 75 from the reservoir under the influence of gravity.

Figure 9:
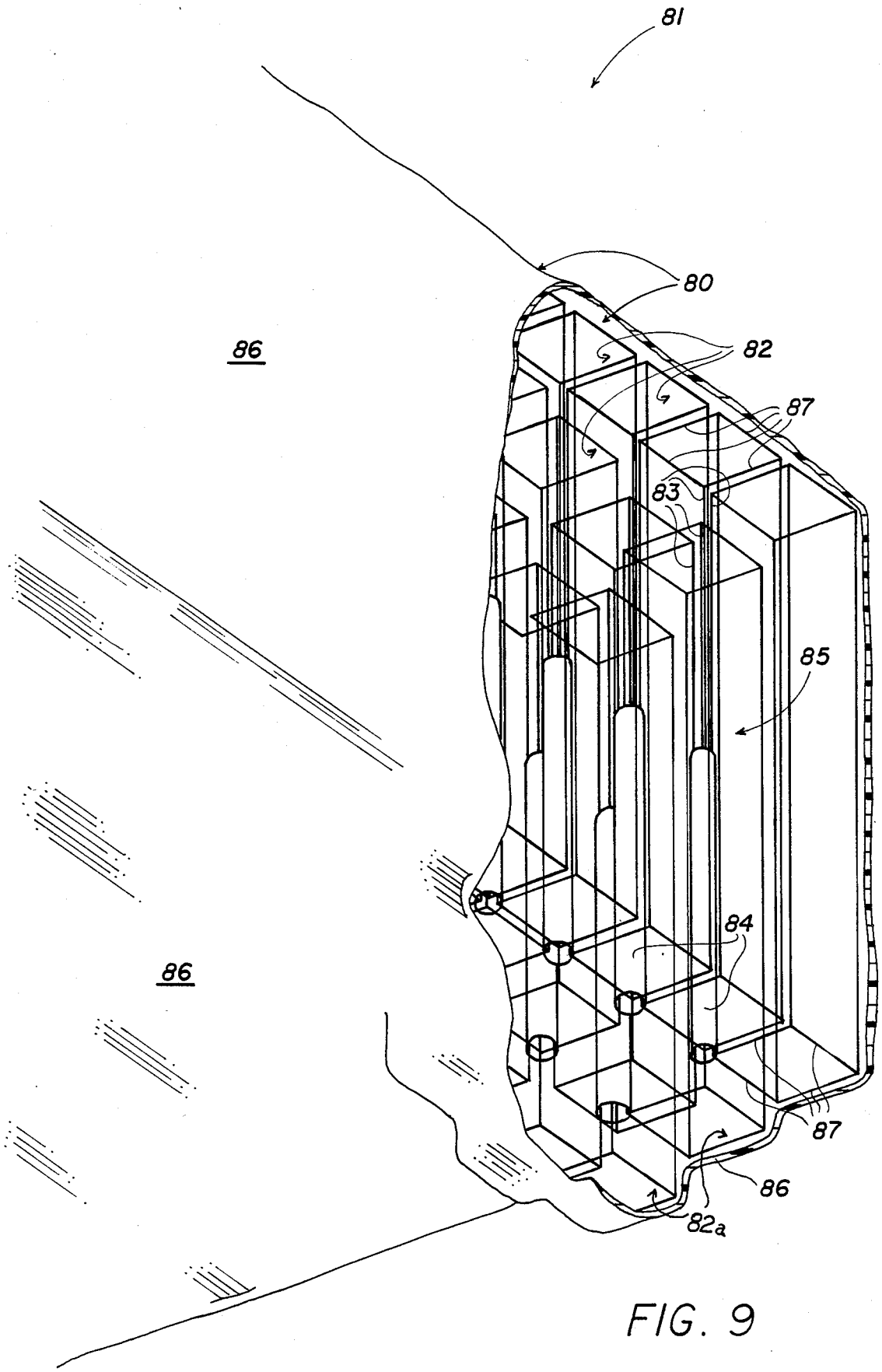

Another support structure 81 according to the invention is illustrated in FIG. 9. The structure 81 includes a two dimensional array 80 of elongated buoys 82 of square cross-section and having parallel, longitudinal axes oriented perpendicular to the array. Each buoy 82 is a skeletal structure filled with a gaseous medium such as air and including four spaced apart, elongated parallel elements 83 having adjacent ends joined by connecting elements 87 to form a hollow cage. Groups of four adjacent buoys 82 are joined by a mooring 85 consisting of an elongated element 83 in each array and a cylindrical coupling band 84 encompassing all of the elongated elements 83. The bands 84 prevent any substantial relative movement between the connected buoys 82 in directions parallel to the array 80 while permitting substantial relative rectilinear movement therebetween parallel to their longitudinal axes and perpendicular to the array 80. The moorings 85 maintain for all buoys 82 in the array 80 a predetermined relative orientation while permitting relative movement therebetween in directions perpendicular to the array as shown by the relative displacement in the array 80 of the buoys 82*a*.

Also included in the array 80 is a highly flexible membrane 86 encapsulating the buoys 82. The membrane 86 is impervious to a fluid medium such as water so as to provide buoyancy therein for the array 80. With the buoys 82 in an aligned quiescent position, the upper surfaces of the membrane covered upper connecting elements 84 form a planar support surface for supporting an object in a manner described below.

During use, the support structure 81 is disposed in a fluid medium, preferably a body of water (not shown) such as a lake, a pool, or the like. Because of the imperviousness of the membrane 86 to the fluid medium, the array 80 floats at its surface. Once so disposed, the aligned membrane covered upper surfaces of the upper connecting elements form a substantially planar engagement surface for engaging and supporting in the in the fluid medium an object (not shown) such as a person. Each buoy 82 in the array 80 that supports the object will respond to forces applied thereby by displacing the encapsulating membrane 86 and sinking downwardly into the fluid medium as shown by the downwardly displaced buoys 82*a* in FIG. 9. The degree of relative vertical displacement of each displaced buoy 82 in the array 80 will depend upon the force applied to its upper surface.

Figure 10:
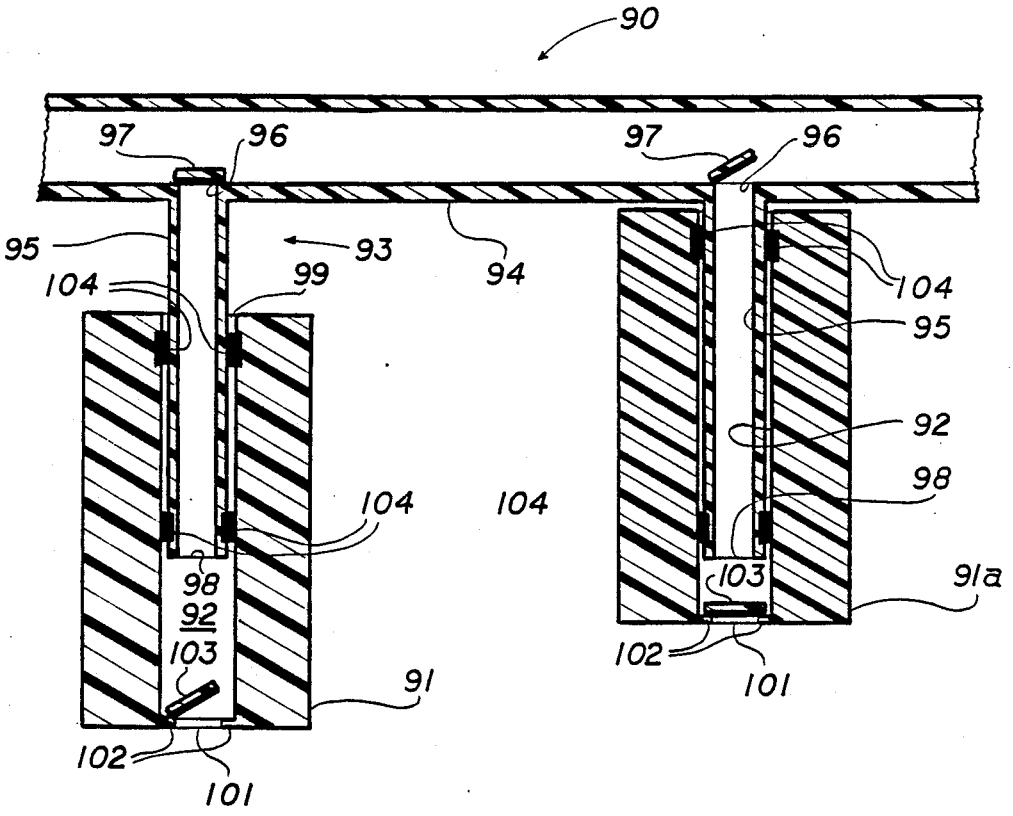
FIG. 10 is a partially cut away perspective view of a modified fluid pumping embodiment of the invention.

Illustrated in FIG. 10 is a modified embodiment 90 similar to the embodiments shown in FIGS. 1–9 but modified to function as a fluid pumping apparatus. Again, the embodiment 90 includes a plurality of elongated buoys 91, 91*a* arranged in a two-dimensional array. Each of the buoys 91, 91*a* is a hollow cylinder buoyant in a fluid medium such as water and defining an elongated central chamber 92. Connecting adjacent buoys 91, 91*a* is mooring 93 consisting of a manifold tube 94 and a plurality of pumping tubes 95. Each pumping tube 95 extends into the cylindrical chamber 92 of a different one of the buoys 91, 91*a* and provides fluid communication therefrom to the manifold tube 94. An inlet end 96 of each pumping tube 95 opens into the manifold tube 94 and is closed by a check valve 97 while an outlet end 98 extends into an upper end 99 of a buoy 91, 91*a* and is fluid tightly sealed within the cylindrical chamber 92 by seals 104. An open lower end 101 of the cylindrical chamber 92 is defined by an annular flange 102 and closed by a check valve 103. As in the above described embodiments, the mooring 93 maintains between the individual buoys 91, 91*a* predetermined orientations for their elongated longitudinal axes and limit relative movement therebetween to rectilinear paths in directions substantially perpendicular to the array of buoys.

During use, the embodiment 90 is disposed in a fluid medium body such as the ocean or a large lake, and the array of buoyant buoys 91, 91*a* float at the surface thereof. In response to wave motion at the surface of the fluid body, the individual buoys 91, 91*a* will experience reciprocating, rectilinear vertical movement on the pumping tubes 95. In FIG. 10, the buoy 91 is shown at the end of a downward stroke while the buoy 91*a* is shown at the end of the opposite or upward stroke. During each downward stroke, the chamber 92 of the buoy 91 is filled with water through the check valve 103. Conversely, during an upward stroke as shown by the buoy 91*a* in FIG. 10, the combined volume of the chamber 92 and the pumping tube 95 is reduced. Resultant fluid pressure within the chamber 92 retains the check valve 103 closed and forces the check valve 97 open to move a portion of the retained fluid through the pump tube 95, and the outlet 96 into the manifold tube 94. During a subsequent downstroke, the check valve 97 is again closed to prevent flow of fluid out of the manifold tube 94 into the chamber 92. The outlet of the manifold tube 94 (not shown) can be positioned in any location at which a supply of water is desired.

Obviously, many modifications and variations of the present invention are possible in light of the above teachings. It is to be understood, therefore, that the invention can be practiced otherwise than as specifically described.

What is claimed:

1. A buoyant structure for use with a fluid medium and comprising:

a two-dimensional array of buoys, said array being buoyant in a fluid medium and adapted to float at the surface thereof and each said buoy comprising a substantially flat upper surface and all said upper surfaces being adopted for quiescent position alignment to form a substantially planar support surface; and mooring means connected between said buoys and adapted to prevent any substantial relative movement therebetween in directions parallel to said array and to allow substantial relative movement therebetween in directions perpendicular to said array.

2. A structure according to claim 1 including limit means for limiting the maximum said relative movement between said buoys in said perpendicular directions.

3. A structure according to claim 1 wherein each of said buoys is an elongated member with a longitudinal axis adapted for orientation substantially perpendicular to said array.

4. A structure according to claim 3 wherein said mooring means is adapted to maintain a parallel relationship between said longitudinal axes of said buoys while allowing said relative movement therebetween.

5. A structure according to claim 4 wherein said mooring means comprises a coupling means connected between each buoy and each directly adjacent said buoy in said array.

6. A structure according to claim 5 wherein each said coupling means comprises a pair of engaged elements each attached to a different one of said adjacent buoys, and said engaged elements are adapted for relative sliding contact during said relative movement between said attached buoys.

7. A structure according to claim 6 wherein each said pair of engaged elements is adapted to allow said relative movement between said attached buoys while preventing relative changes in orientation between said longitudinal axes thereof.

8. A structure according to claim 6 wherein each said pair of engaged elements is adapted to restrict said relative sliding contact therebetween to substantially rectilinear relative motion.

9. A structure according to claim 8 wherein each said pair of engaged elements comprises a ring and an elongated rod retained therein.

10. A structure according to claim 9 wherein each said ring retains a plurality of said rods each attached to a different one of said buoys.

11. A structure according to claim 8 wherein each said pair of engaged elements comprises an elongated channel defined by one of said attached buoys.

12. A structure according to claim 11 wherein each said buoy defines one of said elongated channels, each of said channels retain an elongated rod constituting another of said engaged elements, and all of said elongated rods are connected by connector means.

13. A structure according to claim 12 wherein each of said elongated rods has an end projecting out of its retaining channel, and all said ends are interconnected by said connector means.

14. A structure according to claim 11 wherein each said pair of engaged elements comprises an appendage on another of said buoys and retained by said elongated channel.

15. A structure according to claim 4 wherein said mooring means comprises a band means surrounding the periphery of said array of buoys and maintaining relatively loose transverse contact therebetween so as to prevent said relative parallel movement while allowing said relative perpendicular movement therebetween.

16. A structure according to claim 15 including means defining a sealed compartment disposed above said array.

17. A structure according to claim 15 including means defining with said band means a fluid compartment disposed above said array, means defining a fluid reservoir disposed above said compartment, and fluid communication means defining a fluid flow passage between said reservoir and said compartment.

18. A structure according to claim 4 wherein said array comprises a flexible membrane encapsulating said buoys, said membrane being impervious to the fluid medium so as to provide buoyancy therein for said array.

19. A structure according to claim 18 wherein each of said buoys is a hollow structure filled with a gaseous medium.

20. A structure according to claim 19 wherein each of said buoys is a skeletal structure having a periphery partially defined by a plurality of elongated elements parallel to said longitudinal axes, and said mooring means comprises said elongated elements and a plurality of coupling bands each encompassing at least one of said elongated elements in a plurality of said buoys.

21. A structure according to claim 4 wherein each of said buoys is individually buoyant in the fluid medium.

22. A buoyant structure for use with a fluid medium and comprising:

an array of buoys, said array being buoyant in a fluid medium and adapted to float at the surface thereof, each buoy having a predetermined orientation in said array and each of said buoys being an elongated member with a longitudinal axis adapted for orientation substantially perpendicular to said array; and mooring means maintaining said buoys in said array and adapted to substantially maintain said predetermined orientation for each said buoy while permitting relative movement thereof with respect to other said buoys.

23. A structure according to claim 22 wherein said mooring means is adapted to maintain a parallel relationship between said longitudinal axes of said buoys while allowing said relative movement therebetween.

24. A structure according to claim 22 wherein each of said buoys is individually buoyant in the fluid medium.

25. A buoyant structure for use with a fluid medium and comprising:

an array of buoys, said array being buoyant in a fluid medium and adapted to float at the surface thereof;

mooring means connected between said buoys and adapted to prevent any substantial relative movement therebetween in directions parallel to said array and to allow substantial relative movement therebetween in directions perpendicular to said array; and means defining at least one chamber adapted to receive a fluid in response to movement of said buoys in one direction perpendicular to said array and pump means adapted to discharge the fluid in response to movement of said buoys in a direction opposite thereto.

26. A structure according to claim 25 wherein said means defining said chamber defines a plurality of chambers each associated with a different buoy and adapted to receive fluid in response to movement thereof in said one direction, and said pump means is adapted to discharge fluid from said chamber in response to movement of said associated buoy in said opposite direction.

27. A structure according to claim 26 wherein the fluid that each said chamber is adapted to receive and move is the fluid medium on which said array floats and said chambers are at least partially defined by said buoys.

28. A structure according to claim 27 wherein each of said buoys is buoyant in the fluid medium and said movement thereof in said direction perpendicular to said array is produced by motion of the fluid medium.

* * * * *